US007980210B2

(12) United States Patent
Fujita et al.

(10) Patent No.: US 7,980,210 B2
(45) Date of Patent: Jul. 19, 2011

(54) VARIABLE VALVE DRIVE SYSTEM FOR ENGINE

(75) Inventors: Hideo Fujita, Iwata (JP); Koichi Hatamura, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 531 days.

(21) Appl. No.: 11/961,814

(22) Filed: Dec. 20, 2007

(65) Prior Publication Data

US 2008/0173266 A1 Jul. 24, 2008

(30) Foreign Application Priority Data

Dec. 20, 2006 (JP) ..... 2006-343575

(51) Int. Cl.
*F01L 1/34* (2006.01)

(52) U.S. Cl. ..... 123/90.16; 123/90.41; 123/90.15

(58) Field of Classification Search ..... 123/90.15, 123/90.16, 90.45, 90.41, 90.43
See application file for complete search history.

(56) References Cited

U.S. PATENT DOCUMENTS

| | | | | |
|---|---|---|---|---|
| 4,221,199 | A | 9/1980 | Buuck et al. | |
| 4,572,118 | A | 2/1986 | Baguena | |
| 4,714,057 | A | 12/1987 | Wichart | |
| 4,724,822 | A | 2/1988 | Bonvallet | |
| 5,018,487 | A | 5/1991 | Shinkai | |
| 5,189,998 | A | 3/1993 | Hara | |
| 5,373,818 | A | 12/1994 | Unger | |
| 5,572,962 | A | 11/1996 | Riley | |
| 5,601,056 | A | 2/1997 | Kuhn et al. | |
| 6,135,075 | A | 10/2000 | Boertje et al. | |
| 6,386,162 | B2 | 5/2002 | Himsel | |
| 6,422,187 | B2 | 7/2002 | Fischer et al. | |
| 6,425,357 | B2 * | 7/2002 | Shimizu et al. | 123/90.16 |
| 6,481,399 | B1 | 11/2002 | Morrn | |
| 6,550,435 | B1 | 4/2003 | Zubeck | |
| 6,659,053 | B1 | 12/2003 | Cecur | |
| 6,907,852 | B2 | 6/2005 | Schleusener et al. | |
| 7,069,890 | B2 | 7/2006 | Fujita et al. | |

(Continued)

FOREIGN PATENT DOCUMENTS

DE 43 13 656 A1 10/1994

(Continued)

OTHER PUBLICATIONS

International Search Report for Application No. PCT/JP03/06202.

(Continued)

*Primary Examiner* — Zelalem Eshete
(74) *Attorney, Agent, or Firm* — Keating & Bennett, LLP

(57) ABSTRACT

A valve drive device for an engine include a valve for opening or closing an opening of a port to a combustion chamber, a valve drive member for opening or closing the valve and a drive shaft for driving the valve drive member. The device also includes a variable valve timing mechanism for continuously changing a working angle of the valve corresponding to an operation state of the engine by changing a state of drive force transmission from the drive shaft to the valve drive member. A variable valve clearance mechanism is configured such that a valve clearance that is defined as a gap between the valve and the valve drive member can be set at a first value during a first condition in which the working angle of the valve is large to a second different value during a second condition in which the working angle of the valve is small.

12 Claims, 11 Drawing Sheets

U.S. PATENT DOCUMENTS

| | | | | |
|---|---|---|---|---|
| 7,096,835 | B2 | 8/2006 | Fujita et al. | |
| 7,168,403 | B2 | 1/2007 | Fujita et al. | |
| 2001/0052329 | A1 | 12/2001 | Himsel | |
| 2003/0075131 | A1* | 4/2003 | Gill | 123/90.45 |
| 2003/0127063 | A1 | 7/2003 | Wang | |
| 2005/0126526 | A1 | 6/2005 | Fujita et al. | |
| 2005/0229882 | A1 | 10/2005 | Fujita et al. | |
| 2006/0075982 | A1 | 4/2006 | Fujita et al. | |
| 2006/0102120 | A1 | 5/2006 | Fujita et al. | |
| 2006/0107915 | A1 | 5/2006 | Fujita et al. | |
| 2006/0207532 | A1 | 9/2006 | Fujita et al. | |
| 2006/0207533 | A1 | 9/2006 | Fujita et al. | |
| 2006/0243233 | A1 | 11/2006 | Fujita et al. | |
| 2007/0028876 | A1 | 2/2007 | Fujita | |
| 2007/0204820 | A1 | 9/2007 | Fujita et al. | |

FOREIGN PATENT DOCUMENTS

| | | | |
|---|---|---|---|
| DE | 19708484 | | 9/1998 |
| DE | 10123186 | | 11/2002 |
| EP | 1 361 344 | A2 | 11/2003 |
| EP | 1 650 410 | A1 | 4/2006 |
| EP | 1 666 702 | A1 | 6/2006 |
| GB | 782351 | A | 9/1957 |
| JP | 99707-1986 | | 1/1988 |
| JP | 63-179257 | | 7/1988 |
| JP | 9864/1987 | | 7/1988 |
| JP | 62-255538 | | 11/1988 |
| JP | 63-309707 | | 12/1988 |
| JP | 02-241916 | | 9/1990 |
| JP | 06-017626 | | 1/1994 |
| JP | 06-093816 | | 5/1994 |
| JP | 06-272525 | | 9/1994 |
| JP | 06-307219 | | 11/1994 |
| JP | 07-063023 | | 3/1995 |
| JP | 07-133709 | | 5/1995 |
| JP | 07-293216 | | 7/1995 |
| JP | 09-268907 | | 10/1997 |
| JP | 11-036833 | | 9/1999 |
| JP | 2000-213320 | | 8/2000 |
| JP | 2001-263015 | | 9/2001 |
| JP | 2002-371816 | | 12/2002 |
| JP | 2003-106123 | | 4/2003 |
| JP | 2003-148116 | | 5/2003 |
| JP | 2003-201814 | | 7/2003 |
| JP | 2003-239713 | | 8/2003 |
| WO | WO 02/092972 | | 11/2002 |
| WO | WO 03/098012 | A1 | 11/2003 |
| WO | WO 2004/097186 | A1 | 11/2004 |
| WO | WO 2005/019607 | A1 | 3/2005 |
| WO | WO 2005/019609 | A1 | 3/2005 |

OTHER PUBLICATIONS

International Search Report for Application No. PCT/JP03/06236.

International Search Report for Application No. PCT/JP2004/006426.

International Search Report for Application No. PCT/JP2004/006428.

International Search Report for Application No. PCT/JP2004/012191.

International Search Report for Application No. PCT/JP2004/012192.

International Search Report for Application No. PCT/JP2004/012193.

Anontaphan, Thitiphol. A study of a mechanical continuous rocker arm (VRA), SAE technical paper series 2003-01-0022, 2003 SAE World Congress Detroit, Michigan, Mar. 3-6, 2003.

Official Communication issued in corresponding European Patent Application Na 07024793, completed on Jul. 28, 2010.

* cited by examiner

VARIABLE VALVE DRIVE SYSTEM FOR ENGINE

PRIORITY INFORMATION

This application claims priority to Japanese Patent Application No. 2006-343575, filed Dec. 20, 2006, the entirety of which is hereby incorporated by reference herein.

BACKGROUND OF THE INVENTION

1. Field of the Invention

The present invention relates to an engine and, more particularly, to an engine with a continuously variable type valve drive device.

2. Description of the Related Art

JP Patent Application 2002-143037 discloses a valve drive device for an engine in which the opening period and lift amount of the intake and exhaust valves are continuously varied through a continuously variable valve drive device. In such a continuously variable valve drive device, in a boundary zone between a cam base circular part of a drive surface of a swing cam member and a cam nose part, a cam ramp is provided for a smooth transmission between both zones. The ramp height is determined based upon large lift conditions, which is used in high load operation. In such a configuration, in small lift conditions the ramp height is more than required. On the other hand, in a construction having a valve clearance, that is, a construction not including a lash adjuster for absorbing a valve clearance, generally the valve clearance is constant without depending on operation ranges of the engine. As a result, there is a problem that the small lift side has a ramp height more than required. Thus, the actual working angle becomes wider as an actual ramp height becomes larger, and thus it is difficult to realize a minimum working angle and a minimum lift required for a continuously variable type valve drive system.

SUMMARY OF THE INVENTION

An object and advantage of one embodiment of the present invention is to provide a valve drive device for an engine, in which a most appropriate actual ramp height and actual working angle can be obtained on the large lift side or the small lift side, and a sufficient effect can be realized in the continuously variable valve drive system.

Accordingly one aspect of the present invention is a valve drive device for an engine that includes a valve for opening or closing an opening of a port to a combustion chamber, a valve drive member for opening or closing the valve and a drive shaft for driving the valve drive member. The device also includes a variable valve timing mechanism for continuously changing a working angle of the valve corresponding to an operation state of the engine by changing a state of drive force transmission from the drive shaft to the valve drive member. A variable valve clearance mechanism is configured such that a valve clearance that is defined as a gap between the valve and the valve drive member can be set at a first value during a first condition in which the working angle of the valve is large to a second different value during a second condition in which the working angle of the valve is small.

Another aspect of the present invention is a valve drive device that comprises an exhaust or intake valve configure to open and close an intake or exhaust port, a valve drive member configured to move the valve from an open position to a closed position. a drive shaft configured to drive the valve drive member, and a variable valve timing mechanism configured to continuously change a working angle of the intake or exhaust valve in response to an operation state of the engine. The variable valve timing mechanism comprises a variable valve clearance mechanism configured to change a valve clearance between the valve and the valve drive member from a first value during a first condition in which the working angle of the valve is large to a second different value during a second condition in which the working angle of the valve is small.

Another aspect of the present invention is valve drive device for an engine that comprises a valve for opening or closing an opening of a port to a combustion chamber, a valve drive member for opening or closing the valve, a drive shaft for driving the valve drive member, and means for continuously changing a working angle of the valve in response to an operation state of the engine. The device also includes means for varying the valve clearance defined as a gap between the valve and the valve drive member between a first value during a first condition in which the working angle of the valve is large a second different value during a second condition in which the working angle of the valve is small.

DETAILED DESCRIPTION OF THE PREFERRED EMBODIMENTS

Figure 1:
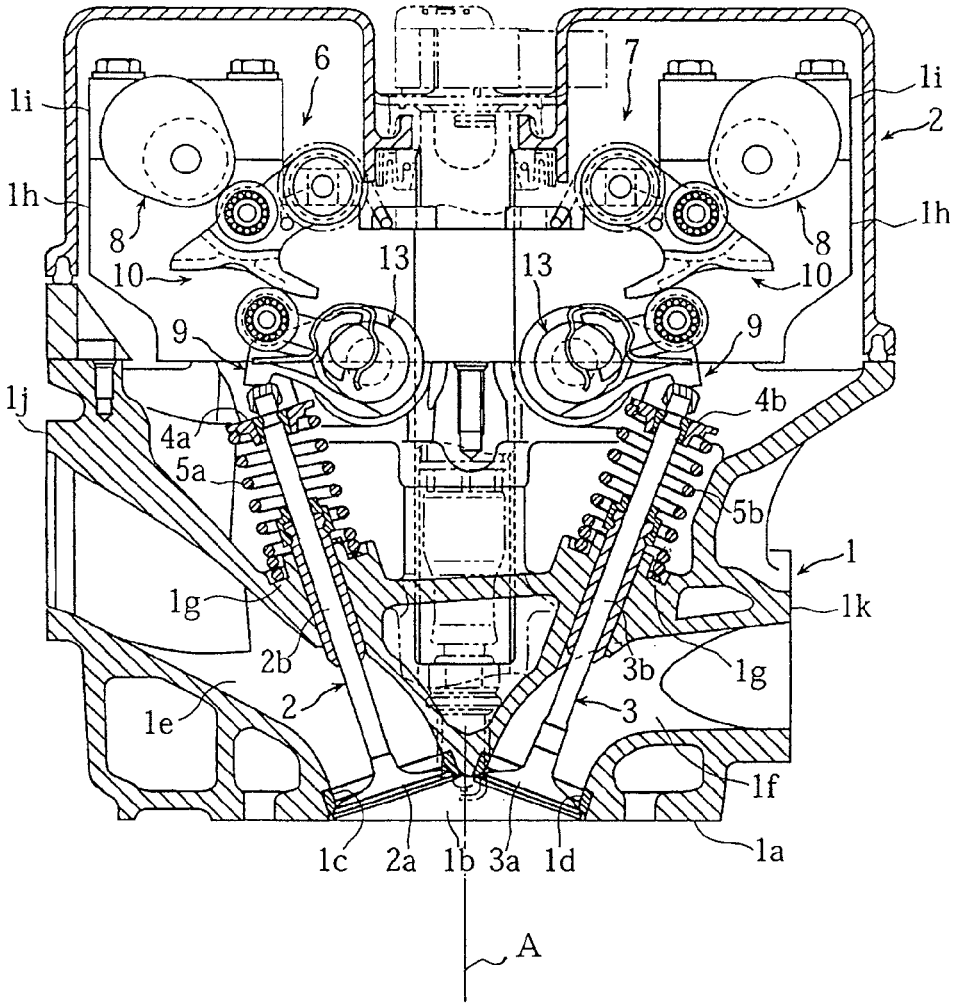
FIG. 1 is a cross-sectional side view of a continuously variable type valve drive device for an engine according to a first embodiment.

FIGS. 1 through 7 illustrate a first embodiment of an engine. With initial reference to FIG. 1, this figures shows a cylinder head 1 that can be joined to a cylinder block (not shown). A head cover 2 can be removably coupled to the cylinder head 1.

An intake valve opening 1*c* and an exhaust valve opening 1*d* can open into a combustion chamber 1*b*. The openings 1*c*, 1*d* can be provided on a contact surface 1*a* of the cylinder head 1, which can contact the cylinder block (not shown). The intake valve opening 1*c* and the exhaust valve opening 1*d* can extend to an inner side wall surface 1*j* and an outer side wall surface 1*k* of a bank by an intake port 1*e* and an exhaust port 1*f*, and open at those parts.

Valve heads 2*a* and 3*a* of an intake valve 2 and an exhaust valve 3 can be disposed on the intake valve opening 1*c* and the exhaust valve opening 1*d* in a manner such that the valve heads 2*a* and 3*a* can open or close the respective openings 1*c* and 1*d*. Valve springs 5*a* and 5*b* can be interposed between retainers 4*a* and 4*b* put on upper ends of valve stems 2*b* and 3*b* of the intake valve 2 and the exhaust valve 3, and spring seats 1*g*, 1*g*, and thereby the valves 2 and 3 can be urged in a direction to close the respective openings.

Opening periods and lift amounts of the intake valve 2 and the exhaust valve 3 can be continuously variable from zero to the largest by an intake side continuously variable type valve drive device 6 and an exhaust side continuously variable type valve drive device 7.

In the illustrated embodiment, the intake side continuously variable type valve drive device 6 and the exhaust side continuously variable type valve drive device 7 have substantially similar constructions. Accordingly, the intake side continuously variable t valve drive device 6 will be mainly described hereinafter. The same reference numerals and symbols as the constructional elements of the intake side will be given to the exhaust side continuously variable type valve drive device 7, and parts different from the intake side will be described.

Figure 2:
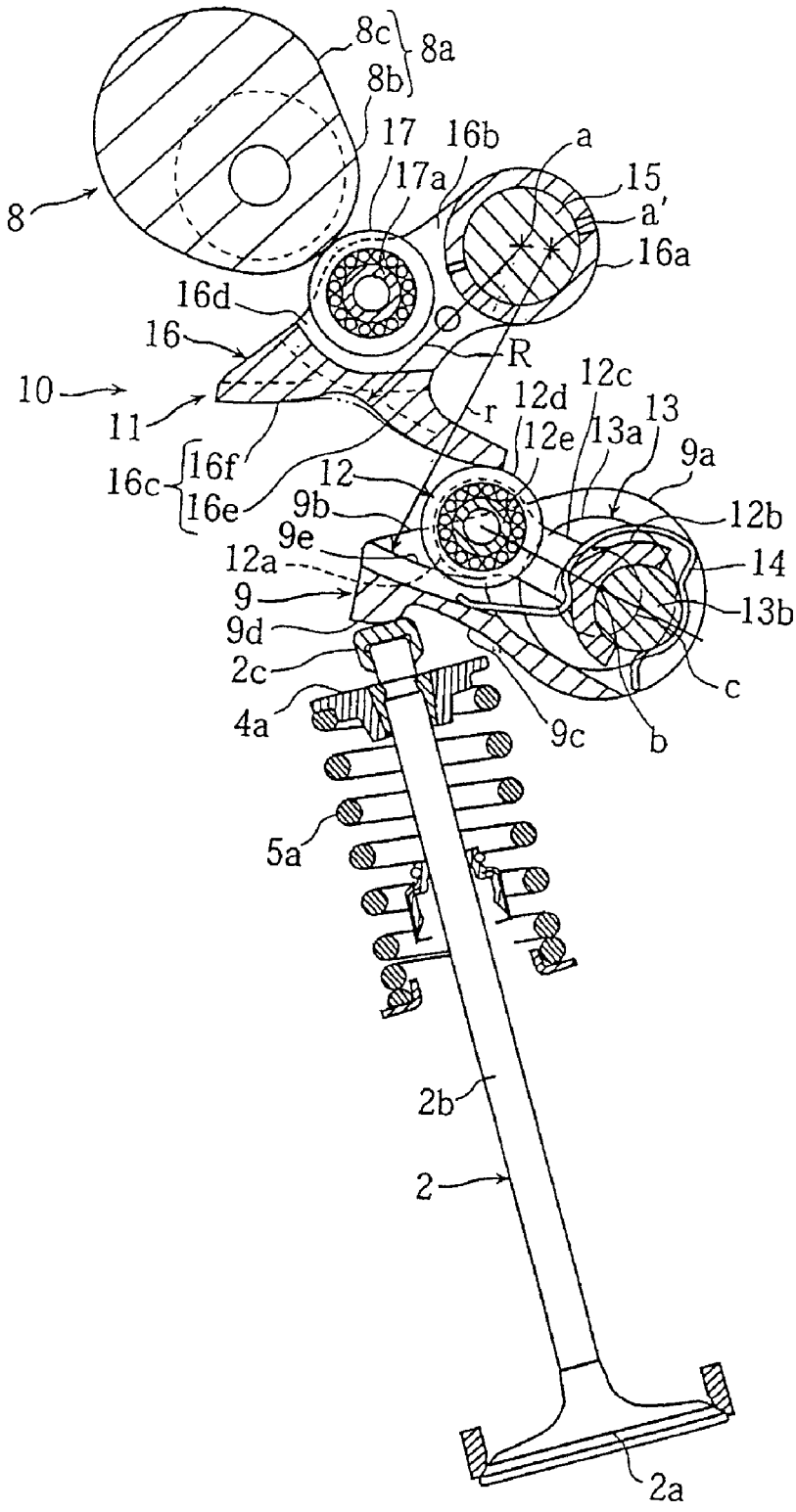
FIG. 2 is a cross-sectional side view of the valve drive device in a condition of a small working angle.
Figure 3:
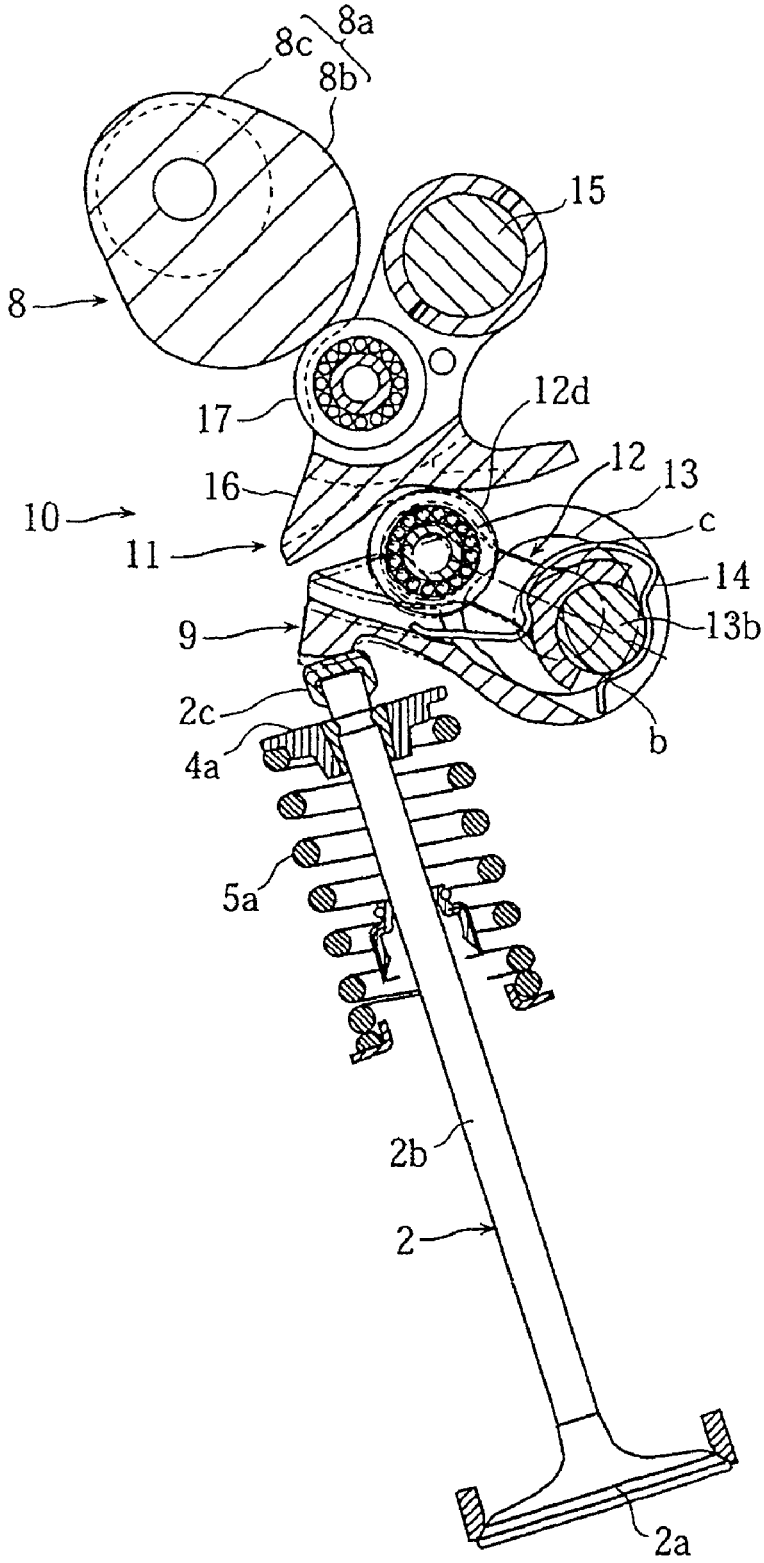
FIG. 3 is a cross-sectional side view of the valve drive device in a condition of a large working angle.

With reference to FIG. 2, The intake side continuously variable valve drive device 6 can include a drive shaft 8 (e.g., a camshaft in the illustrated embodiment), valve drive member (e.g., a rocker arm in the illustrated embodiment) 9 such that rotation of the camshaft 8 is transmitted to and thereby opens or closes the intake valve 2, and a valve working angle variable mechanism 10 disposed between the rocker arm 9 and the camshaft 8 for changing a state of transmission of a drive force by a rotation of the camshaft 8 to the rocker arm 9.

The valve working angle variable mechanism 10 can include a swing cam 11 driven by a cam nose 8*a* of the camshaft 8, an intermediate rocker (control arm) 12 driven by the swing cam 11, and a control shaft (control member) 13 for swingably supporting the intermediate rocker arm 12 and the rocker arm 9 and moving the intermediate rocker arm 12 ahead or back to vary the valve timing. Corresponding with a swing of the swing cam 11, the rocker arm 9 swings via the intermediate rocker arm 12, the intake valve 2 can move ahead or back in the axial direction due to the swing of the rocker arm 9, and thereby the intake valve opening 1*c* is opened or closed.

A set of the cam nose 8*a*, the swing cam 11, the intermediate rocker arm 12, and the rocker arm 9 can be provided for a single intake valve.

The camshaft 8 is disposed in parallel to a crankshaft (not shown), and is supported rotatably and immovably in the direction perpendicular to the axis and the axial direction by a cam journal bearing 1*h* put on the cylinder head 1 and a cam cap 1*i* put on an upper contact surface thereof (see FIG. 1). As shown in FIG. 2, the cam nose 8*a* of the camshaft 8 can include a base circular part 8*b* having a certain outer diameter, and a nose part 8*c* having a prescribed cam profile for opening or closing the intake valve 2 in an intake process.

The rocker arm 9 can have a construction such that both right and left arms 9*b*, 9*b* extend forward from right and left ring-shaped base parts 9*a*, 9*a* are connected together to unify on a bottom wall 9*c*. The right and left base parts 9*a*, 9*a* are supported vertically swingably and immovably in the axial direction and the direction perpendicular to the axis by pivot support parts 13*a*, 13*a* formed on the control shaft 13 disposed in parallel to the camshaft 8 in a part close to a cylinder axial line.

A valve pressing surface 9*d* can be formed on a lower surface of a tip of the bottom wall 9*c* to press a shim 2*c* put on an upper end of the intake valve 2. Pressed surfaces 9*e*, 9*e* can be pressed by a pressing surface 12*a* of the intermediate rocker arm 12 can be formed in a shelf shape on inner surfaces of the respective arm parts 9*b*, 9*b*. The pressed surface 9*e* can be formed to shape a circular arc with a radius (r), of which the center is a point (a') slightly displaced from the swing center (a) of the intake swing cam 11, if viewed in the direction to the camshaft in a state that the valve is fully closed.

An eccentric pin part 13*b* can be formed between the pivot support parts 13*a*, 13*a* of the control shaft 13 to unify with them in a manner such that the eccentric pin part 13*b* has a radius smaller than other parts and is eccentric outside in the radial direction from an axis (b) of the control shaft 13.

A semicircular-shaped rocking base part 12*b* of the intermediate rocker arm 12 is rotatably locked on the eccentric pin part 13*b*. The rocking base part 12*b* and the eccentric pin part 13*b* are connected by a plate spring 14 relatively rotatably and not to separate from each other.

Right and left arm parts 12*c*, 12*c* are formed to unify together and to extend forward on the rocking base part 12*b* of the intermediate rocker arm 12. A rocker roller 12*d* is disposed between front ends of the right and left arm parts 12*c*, 12*c* to roll on a cam surface 16*c* of the swing cam 11. The rocker roller 12*d* is pivotally supported by a roller pin 12*e* passing through the right and left arm parts 12*c*, 12*c* in the axial direction of the control shaft 13.

The pressing surfaces 12*a*, 12*a* are formed on lower surfaces of the front parts of the right and left arm parts 12*c*, 12*c*. The pressing surfaces 12*a* press the respective right and left pressed surfaces 9*e* of the rocker arm 9.

The control shaft 13 is controlled by a drive mechanism such as a servomotor not shown in a manner such that a rotational angle θ is an arbitrary angle. When a rotational angle θ of the control shaft 13 is changed by the drive mechanism, the rocker roller 12*d* and the pressing surface 12*a* of the intermediate rocker arm 12 move along the pressed surface 9*e*, and thereby an actual arm length of the rocker arm 9 and a relative position to the swing cam 11 are changed. Further, for example, corresponding to an opening of an accelerator pedal, the drive mechanism controls a rotational angle of the control shaft 13 so that the opening period (working angle) and the lift amount of the intake valve become larger as the opening becomes larger.

The swing earn 11 can include a swing arm main body 16 supported by a swing shaft 15 disposed in parallel to the camshaft 8 swingably and immovably in the direction perpendicular to the axis and in the axial direction, and a swing roller 17 pivotally supported by the swing arm main body 16. The swing arm main body 16 can be urged clockwise in FIGS. 2 through 5 by an urging spring not shown in a manner such that the swing roller 17 always rolls on the cam nose 8*a*.

The swing arm main body 16 has a general construction such that an arm part 16*b* is formed to extend forward and to unify with a cylindrical base end part 16*a* pivotally supported by the swing shaft 15, and a swing cam surface 16*c* is formed to unify with an end of the arm part 16*b*. A roller disposing space 16*d* is formed as a slit vertically passing through the arm part 16*b*. The swing roller 17 is disposed in the roller disposing space 16*d*. The swing roller 17 is pivotally supported by a roller pin 17*a*. The roller pin 17*a* passes through the arm part 16*b* in parallel to the swing shaft 15.

The swing cam surface 16*c* includes a base circular part 16*e* and a lift section 16*f* formed to connect to an edge part thereof (a part distant from the axis (b) of the control shaft 13). The base circular part 16*e* forms to have a circular arc shape with a radius (R), in which the axis (a) of the swing shaft 15 is the swing center. Therefore, in a period that the base circular part 16*e* rolls on the rocker roller 12*d*, swing angles of the intermediate rocker arm 12 and the rocker arm 9 do not change from zero although a swing angle of the swing cam 11 changes. Thus, the intake valve 2 is retained at a fully closed position, and the lift amount is zero.

On the other hand, the lift section 16*f* more largely swings the intermediate rocker arm 12 and the rocker arm 9 and more largely lifts the intake valve 2 as a part close to an apex part of the nose part 8*c* of the intake camshaft 8 presses the swing roller 17 more, that is, as the swing angle of the swing cam 11 becomes larger.

As described above, the base circular part 16*e* of the swing cam 11 can form a circular arc with a radius (R), of which the center is the swing center (a) of the swing cam 11. Meanwhile, the pressed surface 9*e* of the rocker arm 9 forms a circular arc with a radius (r), of which the center is the center point (a') set at a position a distance (d) displaced from the swing center (a) toward the cylinder axial line (A), in other words, a position in the direction perpendicular to the cylinder axial line (A) and close to the swing center (b) of the rocker arm 9. Therefore, an interval between the base circular part 16*e* and the pressed surface 9*e* in the radial directions (R) and (r) becomes wider as approaching closer to the swing center (b). In other words, the center (a') of the pressed surface 9*e* is displaced to the center (a) of the base circular part 16*c* so that the valve clearance becomes larger as the working angle of the intake valve 2, that is, an opening period that the valve fully opens and a lift amount become smaller, and thereby the valve clearance variable mechanism is formed.

As described above, the center point (a) of the base circular part 16*e* is displaced from the center point (a') of the pressed surface 9*e*, and thereby the interval becomes wider as approaching to the swing center (b) of the rocker arm 9. Therefore, the valve clearance, which is a gap between the shim 2*c* of the intake valve 2 and the valve pressing surface 9*d* of the rocker arm 9 becomes larger as a largest working angle of the intake valve 2 is smaller.

Figure 4:
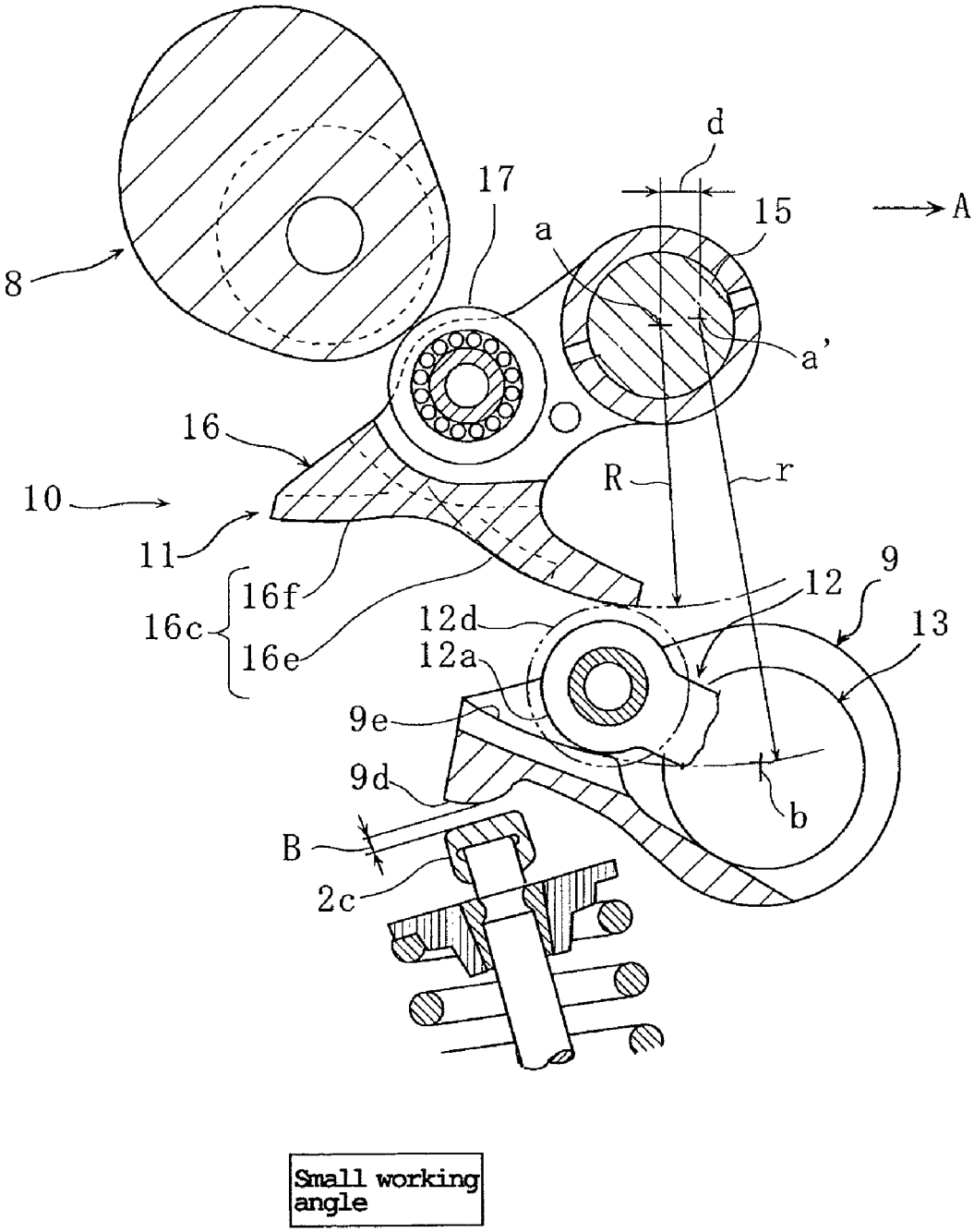
FIG. 4 is an enlarged cross-sectional side view of the valve drive device in a condition of a small working angle.
Figure 5:
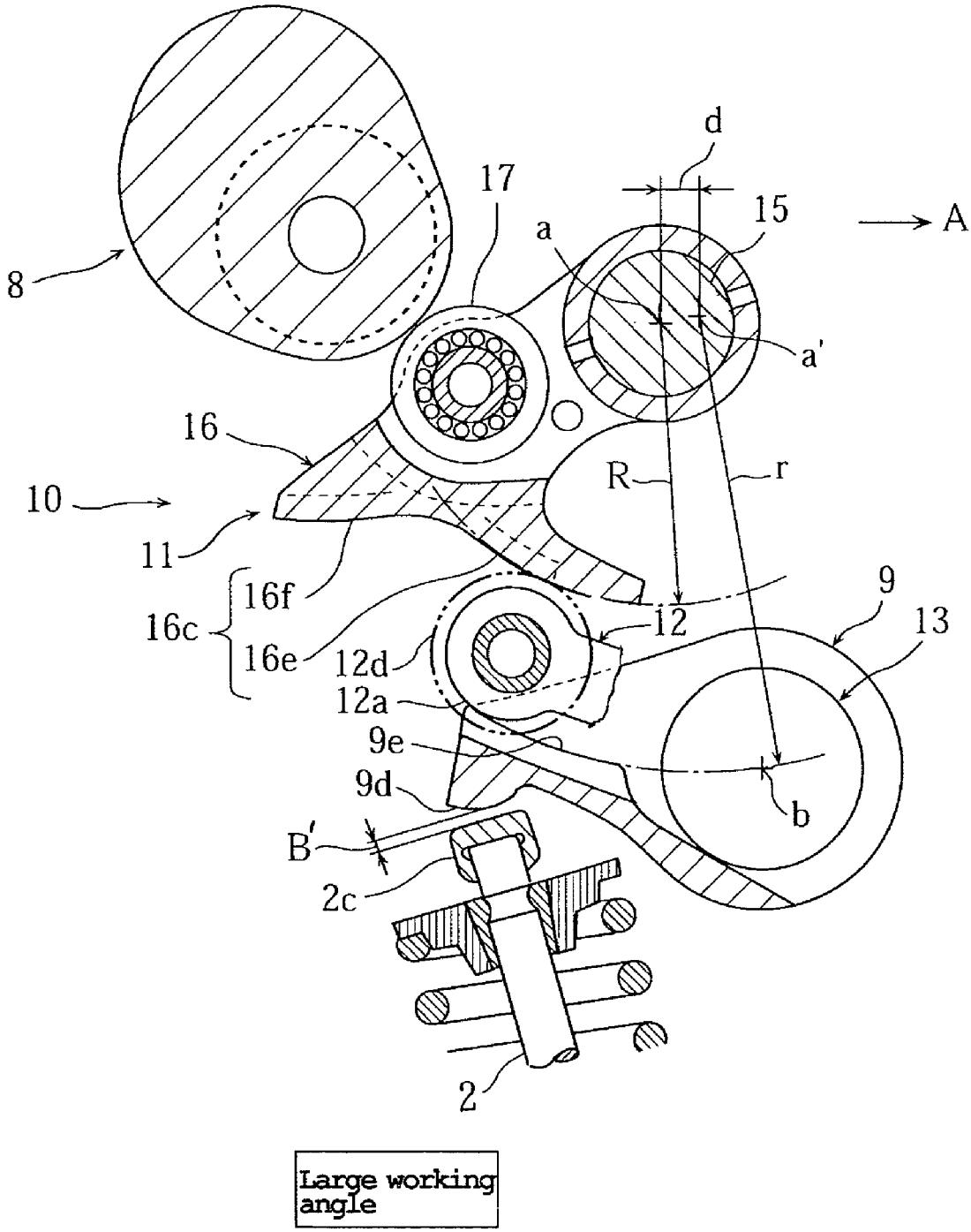
FIG. 5 is an enlarged cross-sectional side view of the valve drive device in a condition of a large working angle.
Figure 6:
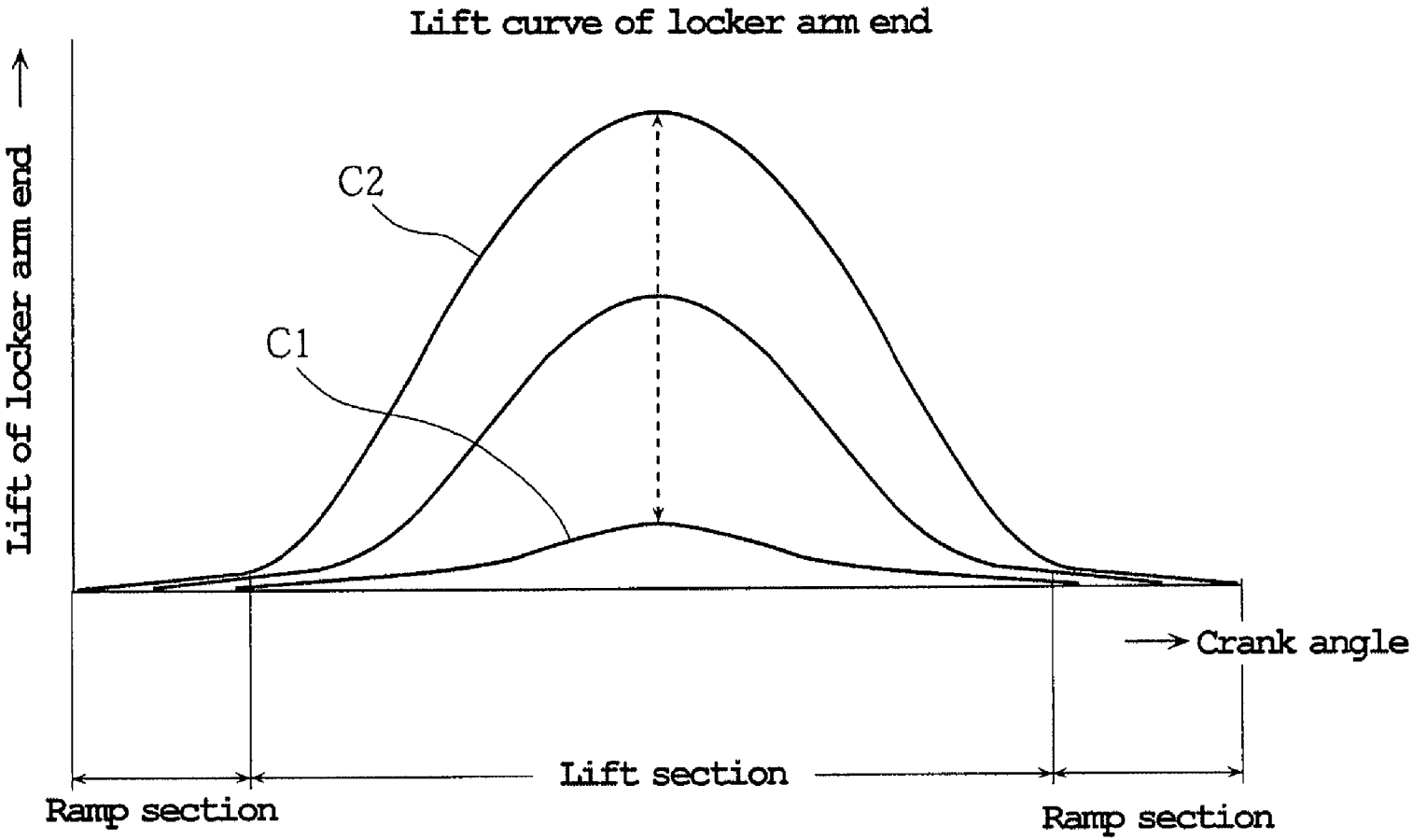
FIG. 6 is a graph indicating lift curves of the valve drive device.

If the rocker roller 12*d* and the pressing surface 12*a* of the intermediate rocker arm 12 are moved back to an edge part of the pressed surface 9*e* close to the swing center (b) by changing a rotational angle of the control shaft 13 as shown in FIG. 4, both the opening period and the valve lift amount of the intake valve 2 become the smallest as indicated by curve (C1) in FIG. 6 indicating the valve lift curves. In this case, the valve clearance is the largest value (B) shown in FIG. 4. On the other hand, if the rocker roller 12*d* and the pressing surface 12*a* of the intermediate rocker arm 12 are moved ahead to an edge part of the pressed surface 9*e* on the side opposite to the swing center (b) as shown in FIG. 5, both the opening period and the valve lift amount of the intake valve 2 become the largest as indicated by curve (C2) in FIG. 6. In this case, the valve clearance is the smallest value (B') shown in FIG. 5. Also, the valve clearance continuously changes from the largest value (B) to the smallest value (B') corresponding to a change in the opening period and the lift amount of the intake valve 2 from the smallest (C1) side to the largest (C2) side.

In the illustrated embodiment of FIGS. 4 and 5, the gap between the pressing surface 9*d* of the rocker arm 9 and the shim 2*c* of the valve 2 is referred as "valve clearance." However, a position that the valve clearance occurs changes depending on an urging direction of each part. For example, the valve clearance may occur between the pressing surface 12*d* of the intermediate rocker arm 12 and the pressed surface 9*e* of the rocker arm 9, or between the roller 12*d* and the base circular part 16*e*. That is, it is anticipated that in modified embodiments the position of the valve clearance can be modified.

FIG. 6 indicates the lift curves in the valve axial direction of the pressing surface 9*d* on the end of the rocker arm. Each of the curves is composed of ramp sections and a lift section. A final valve lift is obtained by subtracting the valve clearance from the curve.

Figure 7:
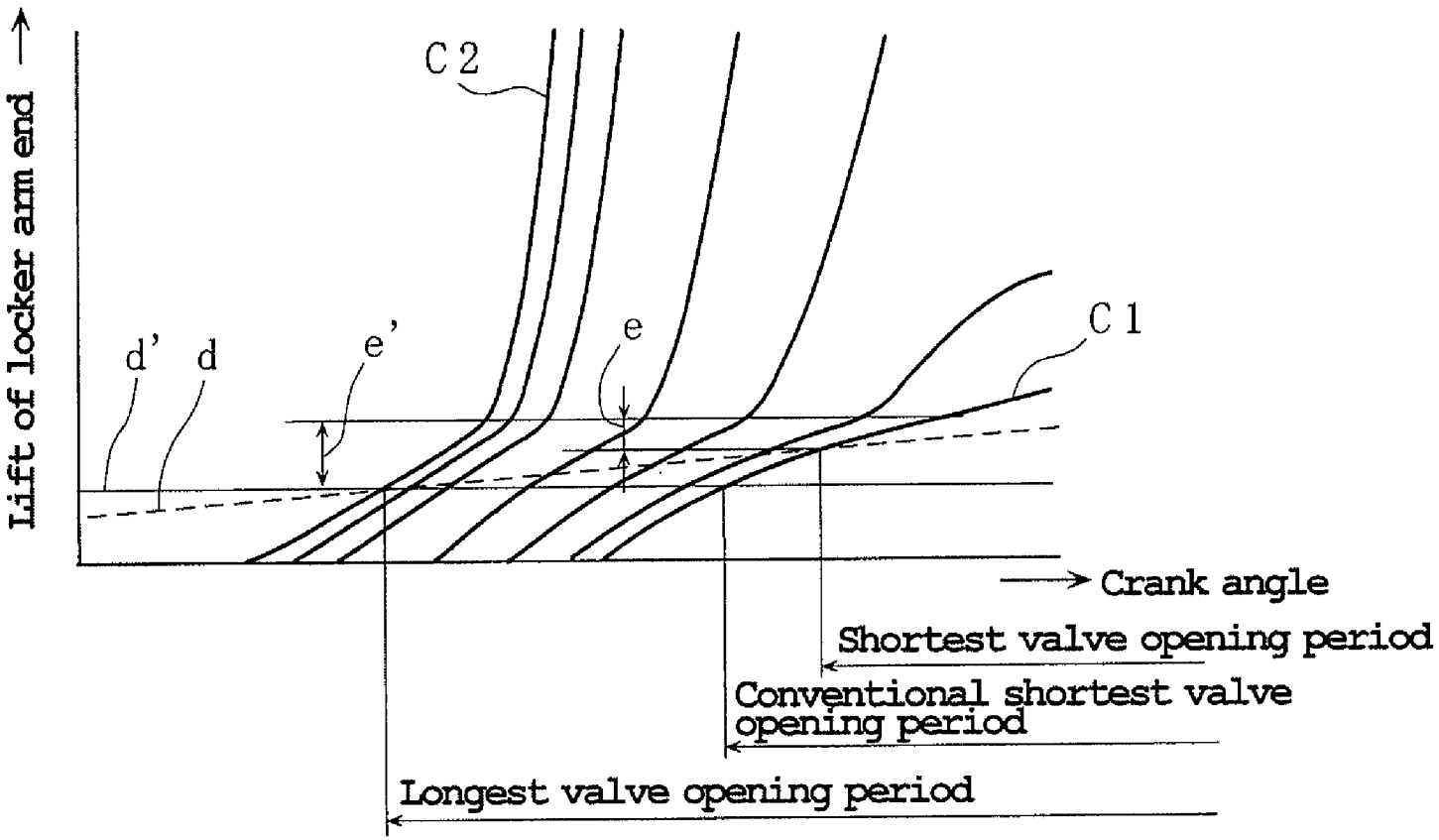
FIG. 7 is an enlarged graph of a ramp section of the lift curves.

FIG. 7 is a graph that the ramp section is enlarged in the lift direction. In FIG. 7, a symbol (d) indicates a valve clearance made larger as the largest working angle becomes smaller, and a symbol (d') shows a constant valve clearance in the conventional device. The valve clearance in this embodiment is set to correspond to the conventional valve clearance at the point that the valve working angle becomes the largest. A symbol (e) indicates an actual ramp height in this embodiment, and a symbol (e') indicates an actual ramp height in the conventional device. In the conventional device, the valve clearance and the actual ramp height (e') are constant without depending on the valve working angle. However, in this embodiment, the valve clearance becomes larger as the valve working angle becomes smaller, and an actual ramp height (e) becomes smaller. As a result, the shortest opening period is shorter than the conventional device. That is, in this embodiment, the opening period and the lift amount of the valve can be largely reduced, and thus the minimum opening period and the minimum lift amount of the continuously variable type valve drive system can be more certainly realized.

Figure 8:
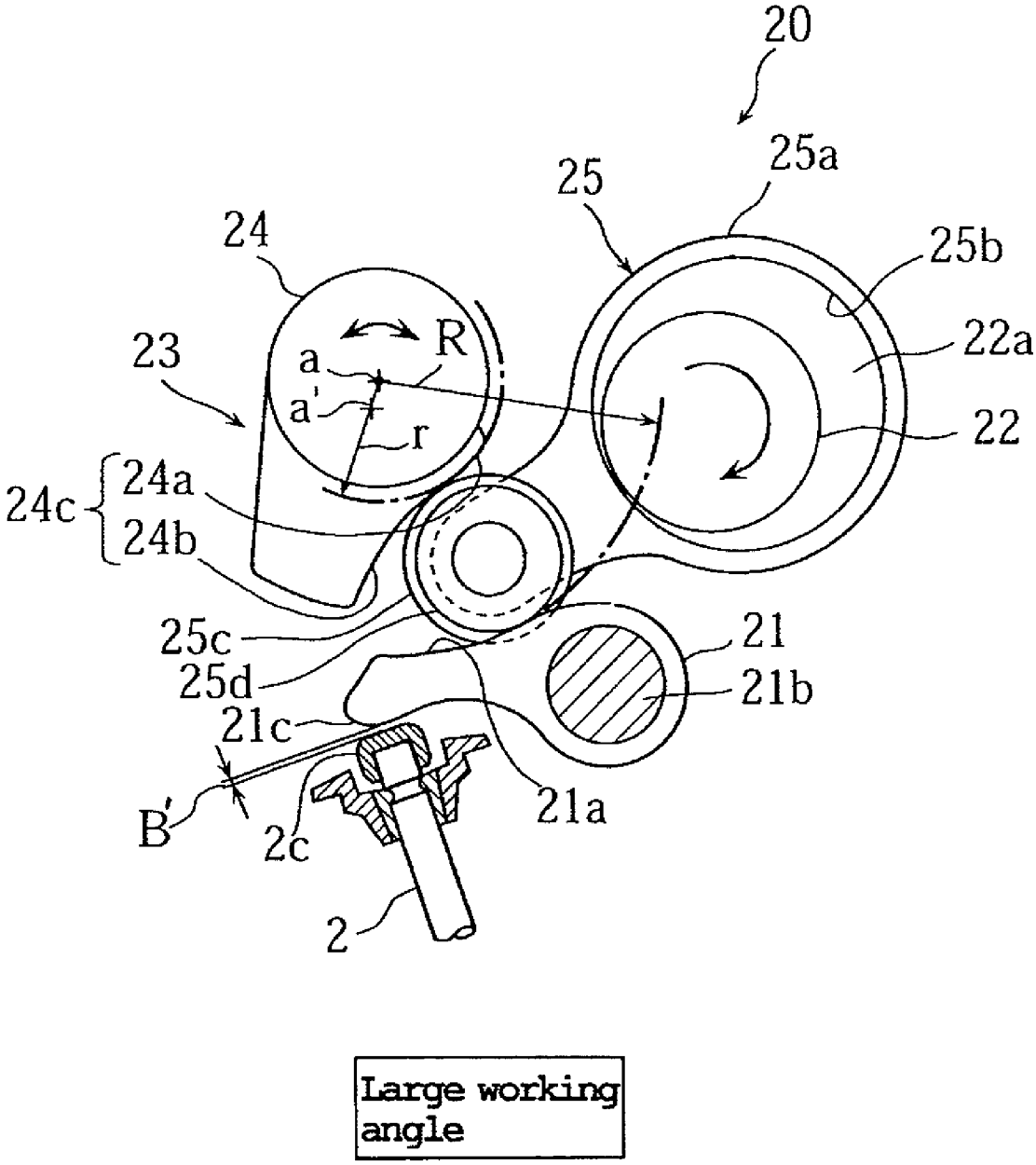
FIG. 8 is a schematic block diagram of a continuously variable type valve drive device according to a second embodiment in a condition of a large working angle.
Figure 9:
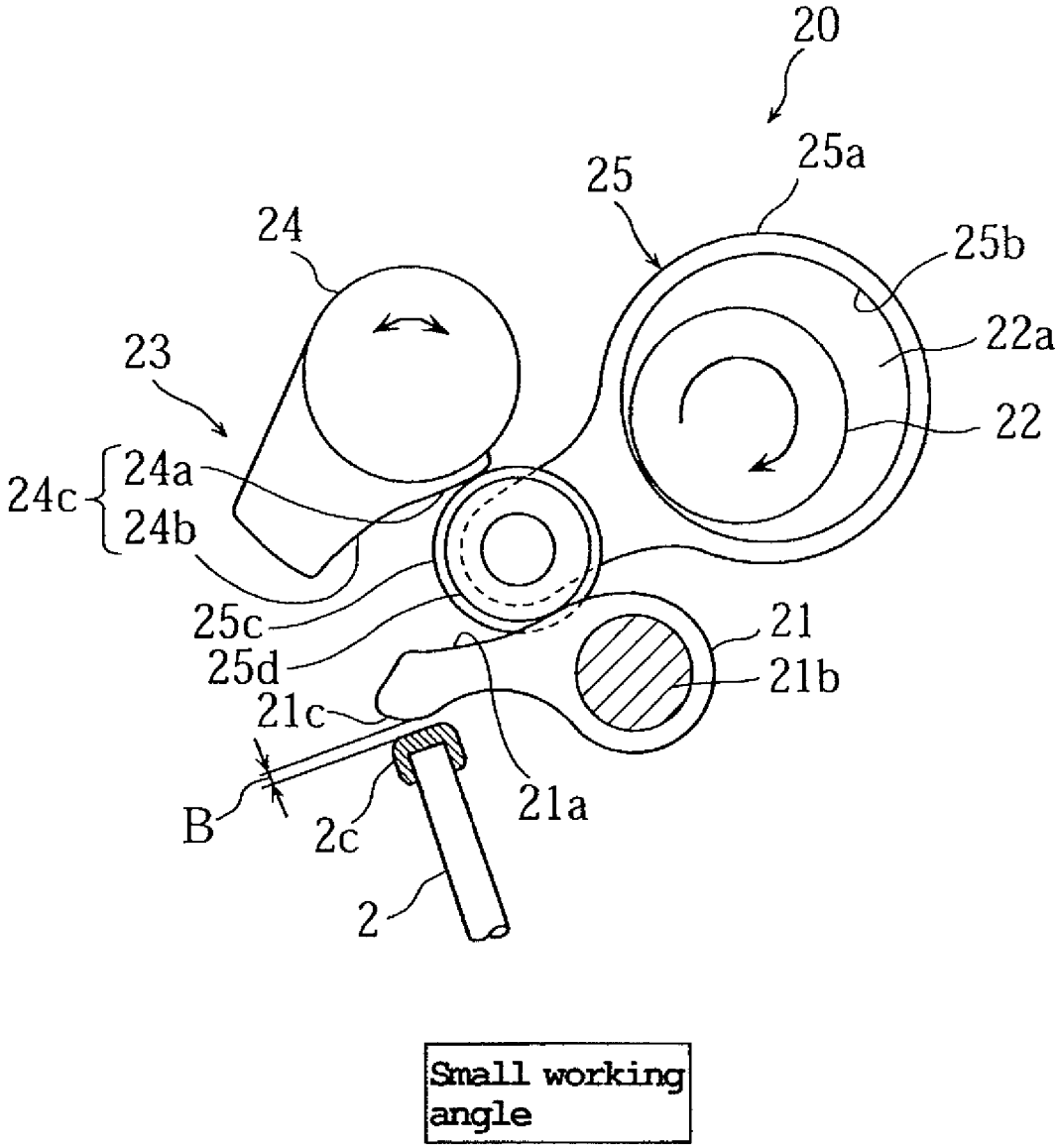
FIG. 9 is a schematic block diagram of the valve drive device according to the second embodiment in a condition of a small working angle.

FIGS. 8 and 9 are drawings for describing the continuously variable type valve drive device according to a second embodiment. The reference numerals and symbols the same as in FIGS. 1 through 5 denote the same or similar parts.

A valve drive device 20 of this embodiment can include a rocker arm (valve drive member) 21 for opening or closing the intake valve 2, an eccentric shaft (drive shaft) 22 for driving the rocker arm 21, and a valve working angle variable mechanism 23 constructed in manner such that a state of drive force transmission from the eccentric shaft 22 to the rocker arm 21 is changed and thereby a largest working angle of the of the intake valve 2 changes.

The valve working angle variable mechanism 23 includes a guide cam 24 having a guide cam surface 24*c* and pivotally supported, and a cam follower 25 disposed between the guide cam surface 24*a* of the guide cam 24 and the a pressed surface 21*a* of the rocker arm 21 and driven by the eccentric shaft 22 to change relative positions to the pressed surface 21 a and the guide cam surface 24*c*.

The rocker arm 21 is swingably supported by a rocker arm shaft 21*b*. When the pressed surface 21*a* formed on an upper edge part thereof is pressed by the cam follower 25, a pressing surface 21*c* formed on a lower part of an end of the pressed surface 21*a* presses the shim 2*c* of the intake valve 2, and thereby the intake valve 2 is opened or closed.

The guide cam surface 24*c* of the guide cam 24 has a base circular part 24*a* formed with a circular arc with a radius (r), of which the center is a point (a') slightly displaced from the swing center (a) of the guide cam 24, and a cam nose 24*b* formed continuously thereto.

The cam follower 25 includes a connecting rod 25*a*, and two rollers 25*c* and 25*d* disposed on an end thereof. An eccentric ring 22*a* of the eccentric shaft 22 is rotatably fitted in a connection hole 25*b* formed on the connecting rod 25*a*. The roller 25*c* put on an end of the connecting rod 25*a*, which is one of the rollers, rolls on the guide cam surface 24*c* of the guide cam 24. The roller 25*d*, which is the other roller, rolls on the pressed surface 21*a* of the rocker arm 21.

The cam follower 25 moves ahead or back linking with a rotation of the eccentric ring 22. The rollers 25*c* and 25*d* swing the rocker arm 21 corresponding to a shape of the guide arm surface 24*c* of the guide cam 24. Thereby, the intake valve 2 is opened or closed.

Here, as the roller 25*c* rolls toward an edge part of the base circular part 24*a* on the opposite side to the cam nose part by rotating the guide cam 24 clockwise in the figure, the largest working angle of the valve becomes smaller (a state in FIG. 9). Conversely, as the roller 25*c* rolls toward an edge of the base circular part 24*a* close to the cam nose by rotating the guide cam 24 counterclockwise in the figure, the largest working angle of the valve becomes larger (a state in FIG. 8).

The rotational center of the pressed surface 21*a* of the rocker arm 21 corresponds to the rotational center (a) of the guide cam 24. On the other hand, as described above, the center point (a') of the base circular part 24*a* of the guide cam surface 24*c* of the guide cam 24 is slightly displaced from the rotational center (a) of the guide cam 24. Therefore, an interval between the base circular part 24*a* and the pressed surface 21*a* becomes wider as the guide cam 24 rotates clockwise in the figure more. As shown in FIG. 9, as the interval becomes wider, the valve clearance becomes a larger value (B) and the largest working angle of the valve becomes smaller. Conversely, the interval becomes narrower as the guide cam 24 rotates counterclockwise in the figure more. As shown in FIG. 8, as the interval becomes smaller, the valve clearance becomes a smaller value (B'), and the largest working angle of the valve becomes larger. In other words, the center (a') of the base circular part 24*a* is displaced to the center (a) of the pressed surface 21*a* so that the valve clearance becomes larger as the valve working angle becomes smaller, and thereby the valve clearance variable mechanism is formed.

In the second embodiment also, the valve clearance becomes larger as the largest working angle of the valve becomes smaller. Therefore, similarly to the first embodiment, an actual ramp height can be made small, and the smallest valve opening period can be certainly made short. Characteristics of the minimum working angle and the minimum lift of the continuously variable valve drive system can be realized.

Figure 10:
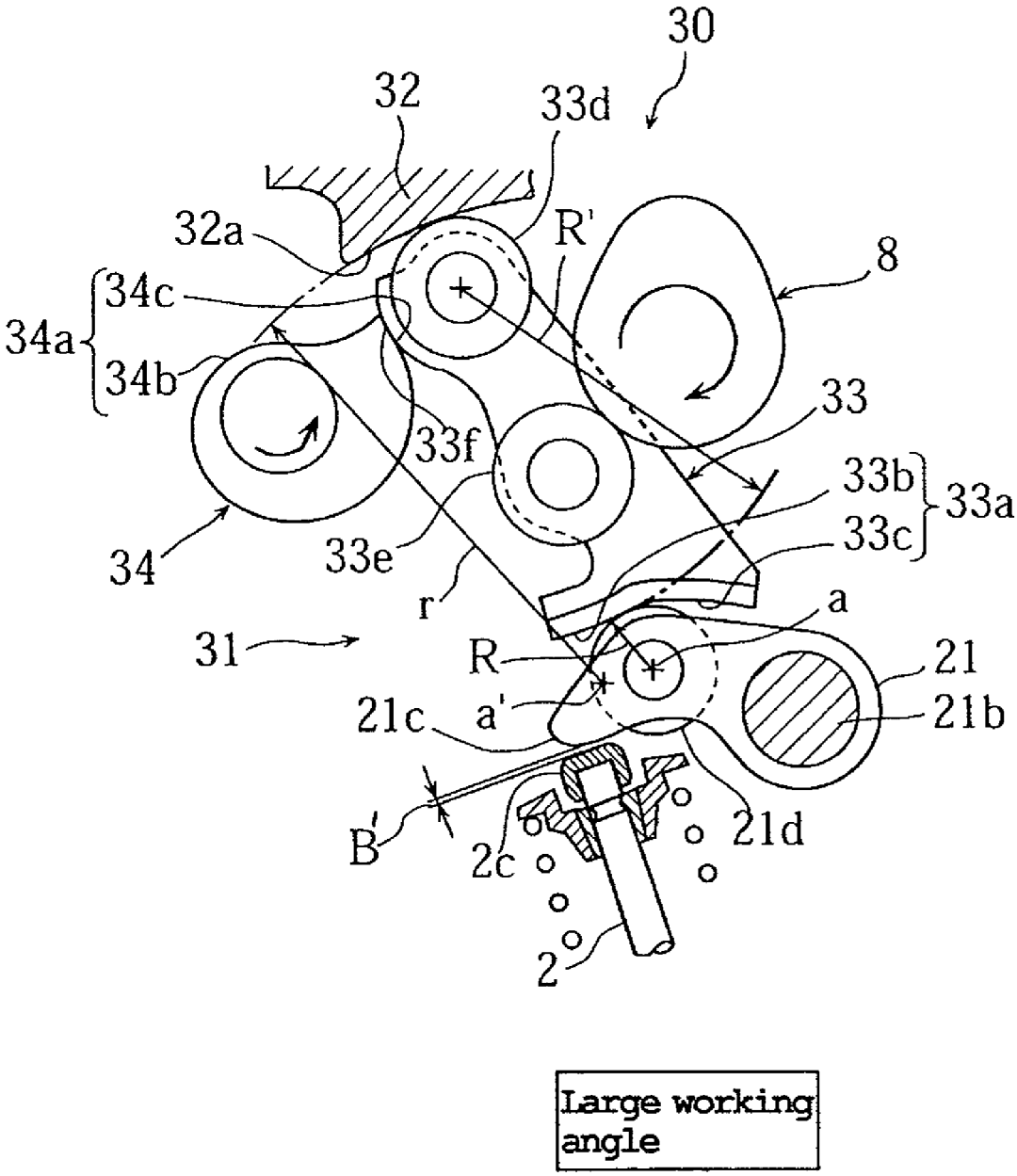
FIG. 10 is a schematic block diagram of a continuously variable type valve drive device according to a third embodiment in a condition of a large working angle.
Figure 11:
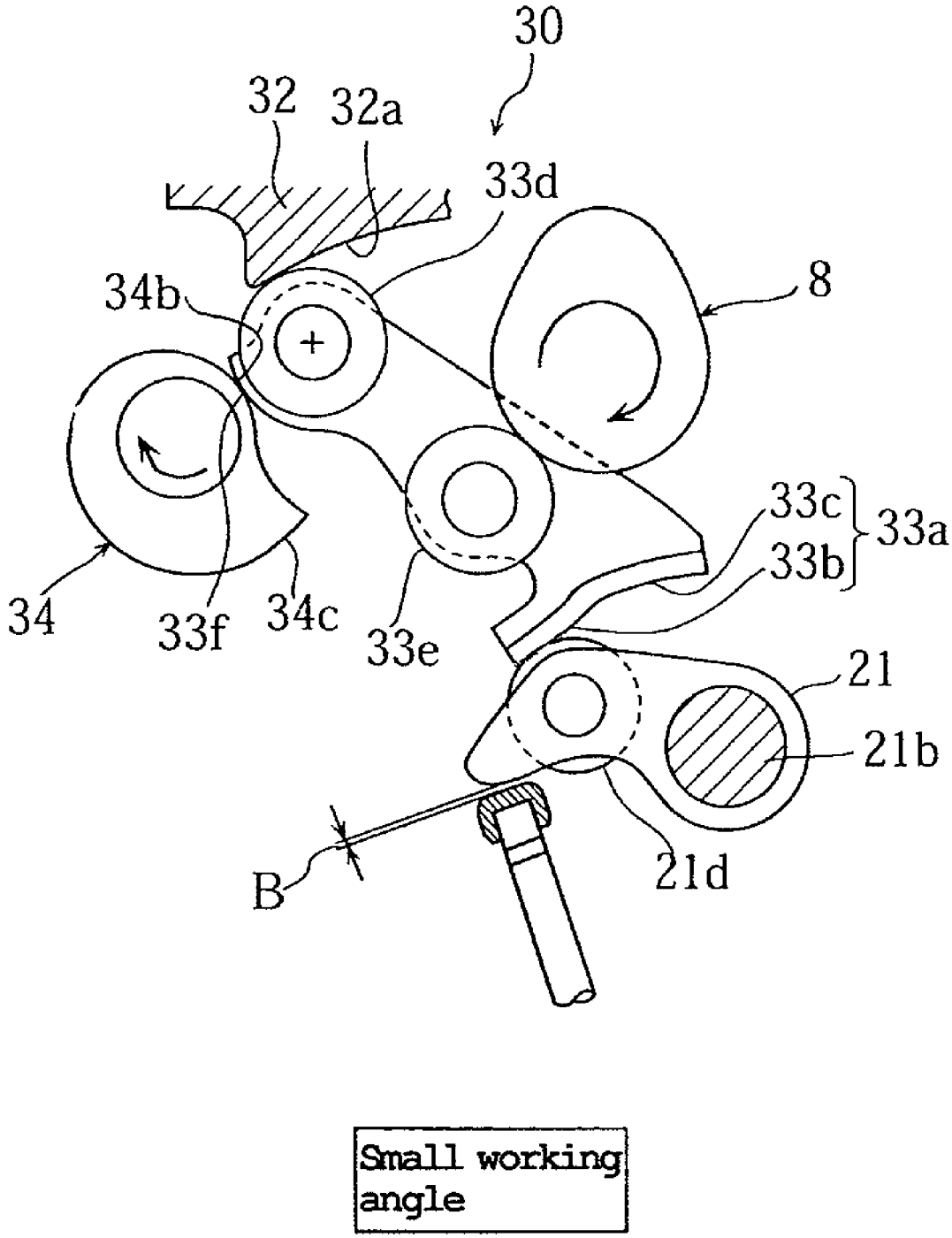
FIG. 11 is a schematic block diagram of the valve drive device according to the third embodiment in a condition of a small working angle.

FIGS. 10 and 11 are drawings for describing a third embodiment in which the reference numerals and symbols the same as FIGS. 1 through 5, and 8 and 9 denote the same or similar parts.

A valve drive device 30 of this embodiment includes the rocker arm (valve drive member) 21 for opening or closing the intake valve 2, and a valve working angle variable mechanism 31 disposed between the rocker arm 21 and the camshaft 8 and constructed in a manner such that a state of drive force transmission from the camshaft 8 to the rocker arm 21 is changed and thereby the largest working angle of the intake valve 2 is continuously changed.

The valve working angle variable mechanism 31 includes a support cam 32 fixedly disposed, and a swing cam 33 disposed between a support surface 32*a* of the support cam 32 and a roller 21*d* forming a pressed surface of the rocker arm 21 and swung by the camshaft 8, and a control cam 34 for changing a supported position of a fulcrum of the swing cam 33 by the support surface 32*a* of the support cam 32.

The swing cam 33 has a drive surface 33*a* formed on an end thereof, which is formed with a base circular part 33*b* and a cam nose part 33*c*, a roller 33*d* disposed on the other end, which is supported by the support cam 32 and the control cam 34, and a roller 33*e* disposed between both the ends, which rolls on the camshaft 8.

The base circular part 33*b* of the drive surface 33*a* forms a circular arc with a radius (R'), of which the center is the axis of the roller 33*d*. The center (a') of the support surface 32*a* of the support cam 32 is set in a position slightly displaced from the center (a) of the roller 21*d* of the rocker arm 21. Therefore, as the roller 33*d* moves toward a part of the support surface 32*a* on the side opposite to the camshaft 8, an interval between the support surface 32*a* of the support cam 32 and the roller 21*d* of the rocker arm 21 becomes narrower, and the valve clearance becomes a larger value (B) (see FIG. 11). On the other hand, as the roller 33*d* moves toward the camshaft 8, the interval becomes wider, and the valve clearance becomes a smaller value (B') (see FIG. 10). In other words, the center (a') of the support surface 32*a* is displaced to the center (a') of the roller 21*d* so that the valve clearance becomes larger as the valve working angle becomes smaller, and thereby the valve clearance variable mechanism is formed.

The control cam 34 has an eccentric cam surface 34*a*. The eccentric cam surface 34*a* is constructed in a manner such that as it rotates clockwise more, its cam height becomes gradually larger from a low cam surface 34*b* to a high cam surface 34*c*.

Here, when the control cam 34 rotates into a state in FIG. 11, the roller 33*d* of the swing cam 33 moves toward a part of the support surface 32*a* on the side opposite to the camshaft 8. Thereby, the largest working angle of the valve becomes smaller and the valve clearance becomes larger. If the control cam 34 rotates clockwise to a state in FIG. 10, the high cam surface 34*c* slides on a cam surface 33*f*, and the roller 33*d* moves toward a part of the support surface 32*a* close to the camshaft 8. Thereby, the largest working angle of the valve becomes larger and the valve clearance becomes smaller.

In the third embodiment also, as the largest working angle of the valve becomes smaller, the valve clearance becomes larger. Therefore, similarly to the first and the second embodiments, an actual ramp height can be made small, and the shortest valve opening period can be certainly made short. Characteristics of the minimum working angle and the minimum lift of the continuously variable valve drive system can be realized.

The above described embodiments advantageously provide a valve drive device for an engine, in which a most appropriate actual ramp height and actual working angle can be obtained in a case of a large lift or a small lift, and an effect of a continuously variable valve drive system can be realized. The center point (a') of a pressed surface 9*e* of a valve drive member 9 can be displaced from the center point (a) of a base circular part 16*e* of a drive surface 16*c* so that a valve clearance (B'), which is a gap between a valve 2 and the valve drive member 9 in the case that a working angle of the valve 2 is large, and a valve clearance (B) in the case that the working angle of the valve 2 is small are different values.

In one embodiment, the valve clearance can be set different values corresponding to working angles of the valve. Thereby, the degree of freedom of the valve clearance can be increased, and an appropriate actual ramp height and actual working angle can be realized on the side of a small valve working angle or the side of a large valve working angle.

For example, if a valve clearance in the case that a valve working angle is small is set larger than a valve clearance in the case that the valve working angle is large, while the valve working angle being the smallest, an actual ramp height can be set smaller corresponding to a largeness of the valve clearance, and thus an actual working angle can be set narrower similarly. As a result, a minimum opening period and a minimum lift amount required for the continuously variable type valve drive device can be realized.

In one arrangement, a center of curvature of the pressed surface of the valve drive member is displaced to a center of curvature of the base circular part of the drive surface of the swing cam member. Also, in another arrangement, a center of curvature of the base circular part of the guide cam surface of the guide cam is displaced to a center of curvature of the pressed surface of the valve drive member. In a further arrangement, a center of curvature of the support surface of the support cam is displaced to a center of curvature of the pressed surface of the valve drive member. Therefore, a valve clearance can be set larger as i valve working angle becomes smaller, and the reduction of an actual ramp height mentioned above can be realized with a simple construction. Accordingly, a minimum working angle and a minimum lift amount can be realized.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A valve drive device comprising:

an exhaust or intake valve configure to open and close an intake or exhaust port;

a valve drive member configured to move the valve from an open position to a closed position;

a drive shaft configured to drive the valve drive member; and a variable valve timing mechanism configured to continuously change a working angle of the intake or exhaust valve in response to an operation state of the engine, the variable valve timing mechanism comprising a variable valve clearance mechanism configured to change a valve clearance between the valve and the valve drive member from a first value during a first condition in which the working angle of the valve is large to a second different value during a second condition in which the working angle of the valve is small; wherein the variable valve timing mechanism includes a swing cam member, which has a drive surface and is swingably supported, and swung by the drive shaft, and a cam follower disposed between the drive surface of the swing cam member and a pressed surface of the valve drive member such that a relative position to a fulcrum of the valve drive member is adjustable, and the variable valve clearance mechanism is configured such that a center of curvature of the pressed surface pressed by the cam follower of the valve drive member is displaced relative to a center of curvature of a base circular part of the drive surface of the swing cam member so that the valve clearance becomes larger as the valve working angle becomes smaller.

2. The valve drive device according to claim 1, wherein the variable valve clearance mechanism sets the valve clearance in the first condition to be smaller than in the second condition.

3. The valve drive device according to claim 1, wherein the valve is an intake valve.

4. The valve drive device according to claim 1, wherein the valve is an exhaust valve.

5. A valve drive device comprising:

an exhaust or intake valve configure to open and close an intake or exhaust port;

a valve drive member configured to move the valve from an open position to a closed position;

a drive shaft configured to drive the valve drive member; and a variable valve timing mechanism configured to continuously change a working angle of the intake or exhaust valve in response to an operation state of the engine, the variable valve timing mechanism comprising a variable valve clearance mechanism configured to change a valve clearance between the valve and the valve drive member from a first value during a first condition in which the working angle of the valve is large to a second different value during a second condition in which the working angle of the valve is small; wherein the variable valve timing mechanism includes a guide cam having a guide cam surface that is rotatably supported and a cam follower disposed between the guide cam surface of the guide cam and the pressed surface of the valve drive member and driven by the drive shaft to change relative positions to the pressed surface and the guide cam surface, and the variable valve clearance mechanism is configured such that a center of curvature of a base circular part of the guide cam surface of the guide cam is displaced relative to a center of curvature of the pressed surface of the valve drive member so that the valve clearance becomes larger as a valve working angle becomes smaller.

6. The valve drive device according to claim 5, wherein the variable valve clearance mechanism sets the valve clearance in the first condition to be smaller than in the second condition.

7. The valve drive device according to claim 5, wherein the valve is an intake valve.

8. The valve drive device according to claim 5, wherein the valve is an exhaust valve.

9. A valve drive device comprising:

an exhaust or intake valve configure to open and close an intake or exhaust port;

a valve drive member configured to move the valve from an open position to a closed position;

a drive shaft configured to drive the valve drive member; and a variable valve timing mechanism configured to continuously change a working angle of the intake or exhaust valve in response to an operation state of the engine, the variable valve timing mechanism comprising a variable valve clearance mechanism configured to change a valve clearance between the valve and the valve drive member from a first value during a first condition in which the working angle of the valve is large to a second different value during a second condition in which the working angle of the valve is small; wherein the variable valve timing mechanism includes a support cam having a support surface, a swing cam member, which is disposed between the support surface of the support cam and the pressed surface of the valve drive member, has a drive surface, and is swung by the drive shaft, and a control cam for changing a supported position of a fulcrum of the swing cam member by the support surface of the support cam, and the variable valve clearance mechanism is configured such that a center of curvature of the support surface of the support cam is displaced relative to a center of curvature of the pressed surface of the valve drive member so that the valve clearance becomes larger as a valve working angle becomes smaller.

10. The valve drive device according to claim 9, wherein the variable valve clearance mechanism sets the valve clearance in the first condition to be smaller than in the second condition.

11. The valve drive device according to claim 9, wherein the valve is an intake valve.

12. The valve drive device according to claim 9, wherein the valve is an exhaust valve.

* * * * *